US009669905B1

(12) United States Patent
Pierce et al.

(10) Patent No.: US 9,669,905 B1
(45) Date of Patent: Jun. 6, 2017

(54) SURFBOARD FIN

(71) Applicants: Bradley Pierce, Dana Point, CA (US); Kevin Chapin, Dana Point, CA (US)

(72) Inventors: Bradley Pierce, Dana Point, CA (US); Kevin Chapin, Dana Point, CA (US)

( * ) Notice: Subject to any disclaimer, the term of this patent is extended or adjusted under 35 U.S.C. 154(b) by 0 days.

(21) Appl. No.: 14/757,208

(22) Filed: Dec. 7, 2015

(51) Int. Cl.
*B63B 35/79* (2006.01)
*B63B 1/00* (2006.01)

(52) U.S. Cl.
CPC ..... *B63B 35/7926* (2013.01); *B63B 1/00* (2013.01); *B63B 35/79* (2013.01)

(58) Field of Classification Search
CPC B63B 1/00; B63B 35/73; B63B 35/79; B63B 39/00; B63B 41/00; B63B 35/00
USPC ..... 114/140; 441/79
See application file for complete search history.

(56) References Cited

U.S. PATENT DOCUMENTS 6,106,346 A * 8/2000 Bolen ..... B63B 35/7926 114/39.15
6,217,402 B1 * 4/2001 Bolen ..... B63B 35/7926 114/140
6,767,266 B2 * 7/2004 Bolen ..... B63B 35/7926 114/140
9,248,892 B1 * 2/2016 Young ..... B63B 39/06

* cited by examiner

*Primary Examiner* — Lars A Olson
(74) *Attorney, Agent, or Firm* — G. Donald Weber, Jr.

(57) ABSTRACT

A fin with a unique design for use with surfboards.

20 Claims, 7 Drawing Sheets

SURFBOARD FIN

FIELD OF THE INVENTION

A unique fin for use with a surfboard. The subject fin includes a base which is adapted to be attached to the underside of the surfboard. The base is, essentially, the "bottom" of the fin which is, typically, inserted into and secured in a slot in the bottom surface of the surfboard.

The base can be a solid configuration or any other suitable structural configurations such as apertures, slots or the like as desired.

The body of the fin, also referred to as the "sail" portion, typically, has a swept-back "shark fin" configuration with at least one arcuate or curved section formed therein and extending therethrough from edge to edge intermediate the base and the nether end (tip) of the sail.

RELATED APPLICATION

Reference is made to the co-pending design patent application entitled SURFBOARD FIN by the common inventors, filed in the PTO on Jan. 26, 2015 and having Ser. No. 29/474,741.

BACKGROUND

The sport (or activity) of surfing is popular throughout much of the world, particularly in areas adjacent to large bodies of water with naturally rolling surf. There are, of course, locations which do not enjoy these natural phenomena but do have the facility to provide artificial or manmade surf conditions.

Surfing extends across a broad spectrum of human activity. For example, the sport can be purely recreational and enjoyed by all manner of participants with various skill levels. In addition, the sport extends into the professional arena with highly skilled "surf riders" or "surfers" competing for monetary (and similar) prizes and awards.

The sport is known to have been in existence for hundreds of years. History records surfing as being known and practiced by Pacific Islanders and Ancient Polynesians. In some very early cases, political and/or social status was said to be established by surfing skills.

In the early days, the "surf boards" (or boards) were rudimentary articles generally comprised of naturally occurring products such as fallen trees, stiff or rigid fronds or the like. These articles were improved, refined and reformed by the riders to enhance their surfing skills.

Originally, the boards were rather large, for example, up to 9 feet in length (or even longer). Over time, the size of the boards, generally, got smaller as did the weight thereof. Wood boards were replaced by Styrofoam or compound resin boards, typically, encapsulated within skins of various types of plastic materials. Fins were added to the boards, primarily for stability, and even expanded to multiple fin configurations. The surfing industry exploded.

The more recent innovations have been made largely in the fin design. The fin shapes have been made smaller and less bulky. They have also been made as a planar device which is configured in a vertical arc that resembles somewhat a letter "C" or the fin of a shark.

A major manufacturer in this field, for example Futures Fin Technology (FFT), produces many fins with this "crescent" shape. These fins comprise a generally planar element which is attached to the underside or bottom surface of the surfboard and include a curved "sail" which is, typically, shaped somewhat like a boomerang or the like.

Some of the newer fins incorporate multiple segments which are joined in specialized configurations. For example, ELEVON, produced by FFT, is comprised of a generally planar vertical portion which is mounted to the surfboard, perhaps at a modest angle, and a "sail" which has the "shark fin" shape which are so-named because they resemble the dorsal fin of some sharks.

Adjacent the upper or free end of the "shark fin sail," a supplementary fin segment is affixed to the shark fin. The supplementary fin segment may be a curved component with an arc of approximately 90° which is joined to the shark fin.

Each of these fins is believed to provide certain advantages in surfing activities. Meanwhile research in this area continues.

DESCRIPTION OF A PREFERRED EMBODIMENT

This invention relates to an accessory frequently referred to as a fin for use with a surfboard. The inventive fin has one or more arced or curved sections horizontally disposed in its vertical length as measured from the bottom surface of the surfboard. The arcs are disposed substantially parallel to the base of the fin and, thus, the bottom of the surfboard. The fins provide a more stable ride on the surfboard.

The novel fin is constructed to be used as an "original equipment" component of a surfboard or as an "add-on" component which can be used with an existing surfboard with little or no renovation of the surfboard.

Figure 1:
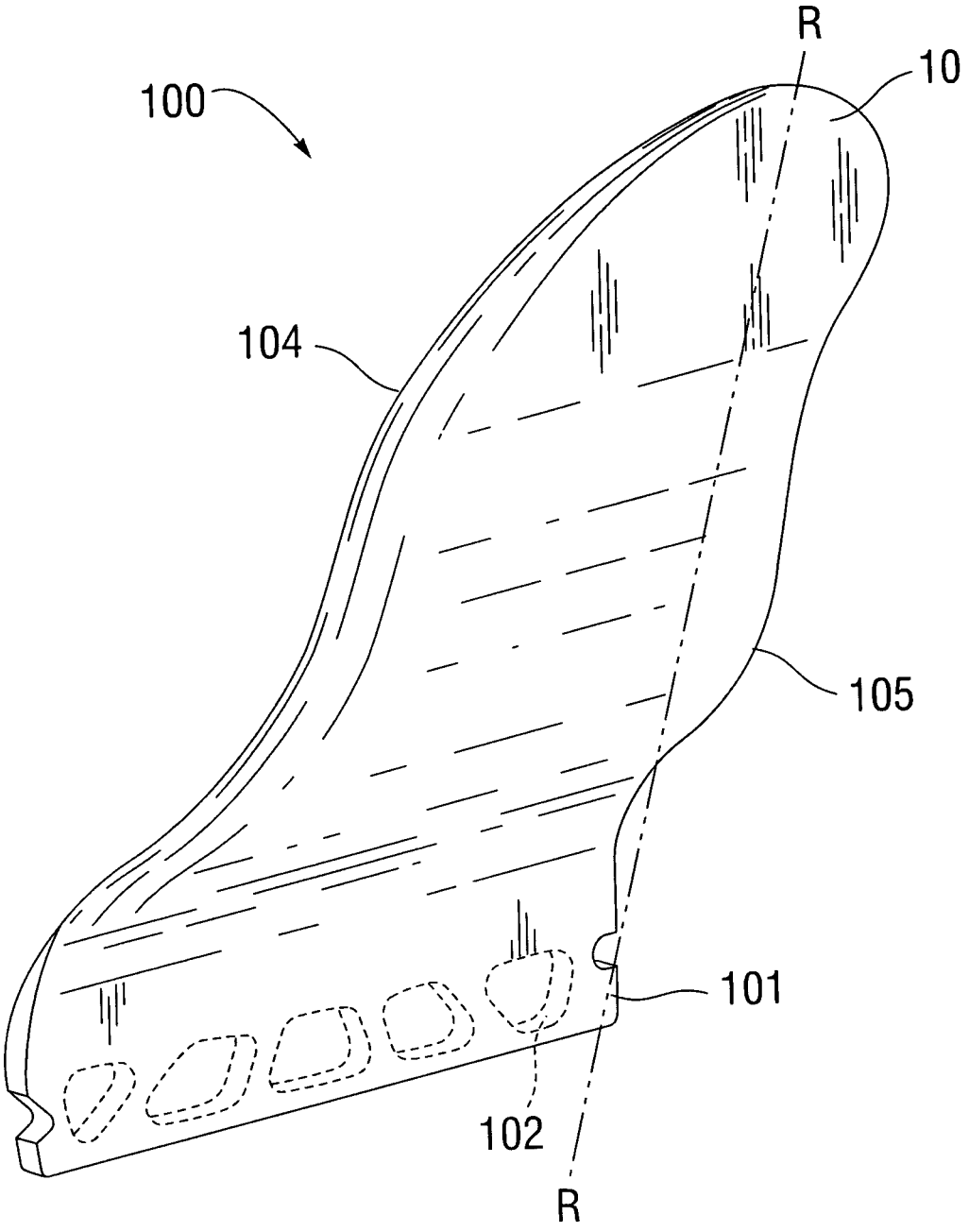
FIG. 1 is a perspective view of the surfboard fin of the instant invention depicting a frontal edge and side surface thereof.

Referring now to FIG. 1, there is shown a perspective view of surfboard fin 100 which is a preferred embodiment of the invention.

The fin 100 is adapted to be mountable to the underside of a surfboard (see infra). The bottom edge (or end) 101 of fin 100 is approximately 4.5 inches long and fabricated to be mounted in a slot in the underside of a surfboard. The end 101 (aka the base) is frequently fabricated as a solid section of the fin 100 which is inserted into a slot provided in the under surface of the surfboard and secured thereto in any suitable manner.

It is further contemplated that, if desired, the end 101 can be fabricated with one or more openings 102 (shown dashed) provided adjacent to or within the end 101. This alternative design configuration is utilized to reduce cost of materials, reduce the weight of the fin and/or provide an alternative arrangement for securing the fin to the board.

The fin 100 can be manufactured of the same material, such as, but not limited to, plastic, resin or rubber as is currently used in the manufacture of conventional fins. Likewise, virtually the same processes can be utilized as are utilized to fabricate the conventional, independent fins. The fins may be molded, pressed or formed by any conventional manufacturing process.

The top section 103 of the fin (also known as the sail) is formed in a swept back configuration which is common in many surfboard fins. The sail has a vertical dimension of approximately 5.5 inches from the tip 103 thereof to the base or bottom edge 101 of the fin.

The front and rear edges 104 and 105, respectively, (as well as the edges of top section 103) of the sail are tapered or rounded in order to present a small or thin surface area in order to enhance the ability for cutting through the water as well as to reduce drag when in use.

Typically, the sail portion (which can be generally considered to be a planar, triangularly shaped component) of the fin is about 0.5 inches thick at the base end and tapers smoothly to about 0.4 inches thick or less at the upper end 103.

The sail is, preferably, swept back at approximately a 30° angle from the front end of the base or bottom end 101 which is similar to the "shark fin" configuration of the conventional fin.

Figure 2:
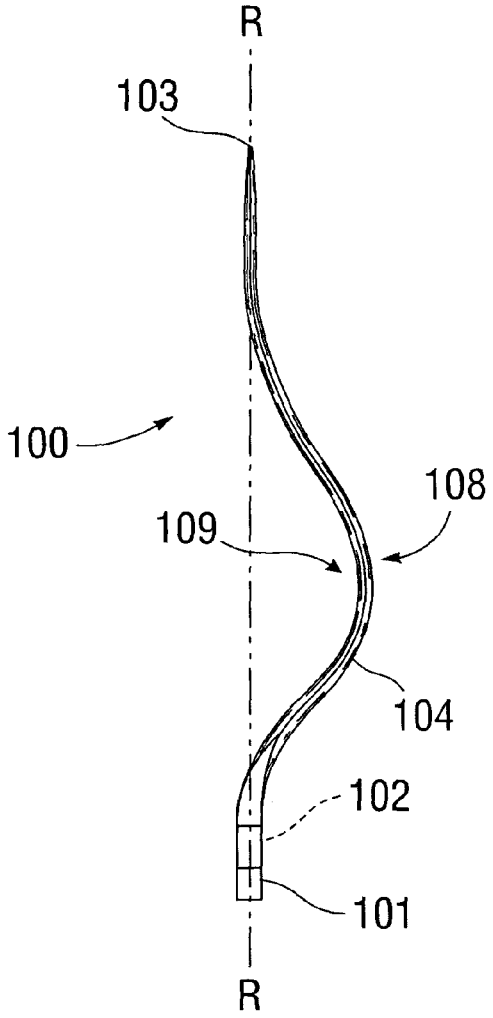
FIGS. 2 and 3 are front and rear elevation views, respectively, of the surfboard fin shown in FIG. 1.
Figure 3:
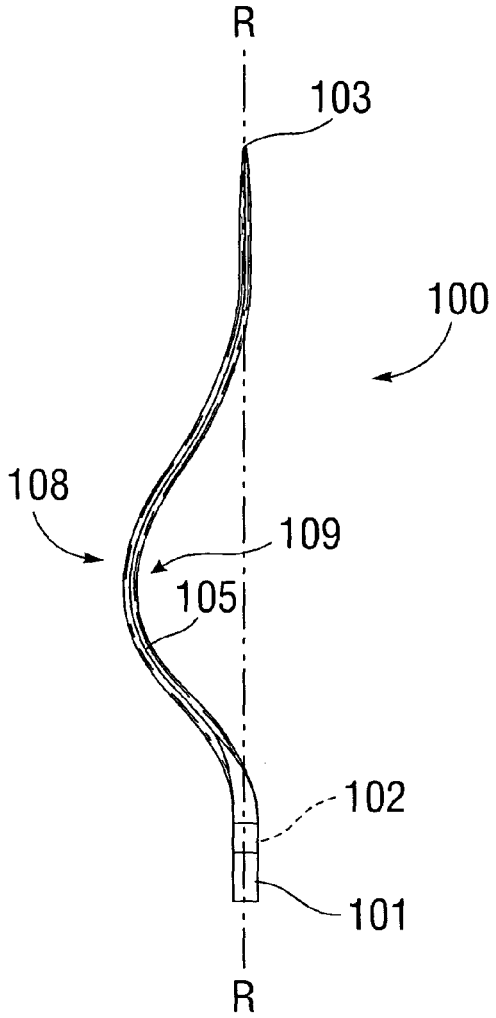

Referring concurrently to FIGS. 1, 2 and 3, the main body of the fin 100 (within the edges described supra) is constructed to have a sinuous or "undulating" configuration with a combination of peaks 108 and valleys 109. The peaks and valleys are created by the curved or accurate sections formed in the sail. The peaks and valleys are each arranged substantially horizontally and parallel to the bottom end (or edge) 101 of fin 100 as seen best in FIGS. 2 and 3. Typically, the peaks/valleys are basically mirror images of each other and are substantially parallel to each other and to the bottom surface of the surfboard.

It will be seen that the lower portion 104 or 105 of the sail 100 deviates from a true vertical path (as suggested by rotational axes R) while the upper portion of the sail 103 extends beyond the curved portions (or arcuate sections) 108 and 109 of the sail and resumes the basic shape of the sail. Thus, the upper 103 and lower 101 portions of the sail 100 are nearly co-planar with each other and an arcuate (or curved) section 108/109 is disposed therebetween.

A virtual rotation line R-R (shown dashed) is provided in FIG. 1 to assist in the understanding of the fin configuration as shown in FIGS. 2 and 3. This arrangement of a pair of the new fins 100 is sometimes referred to as the "knock-kneed" configuration because of the shape thereof.

Figure 4:
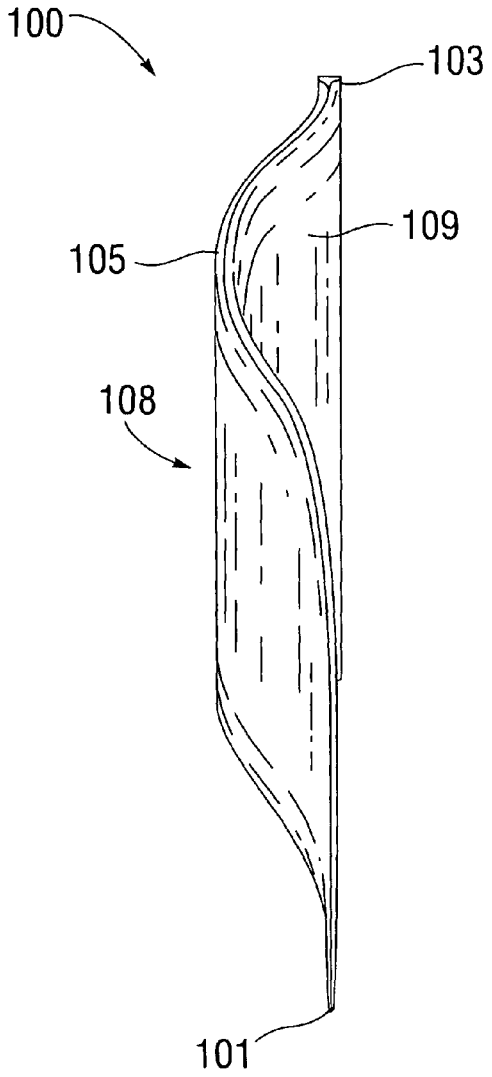
FIGS. 4 and 5 are plan views of the surfboard fins shown in FIGS. 2 and 3, respectively.
Figure 5:
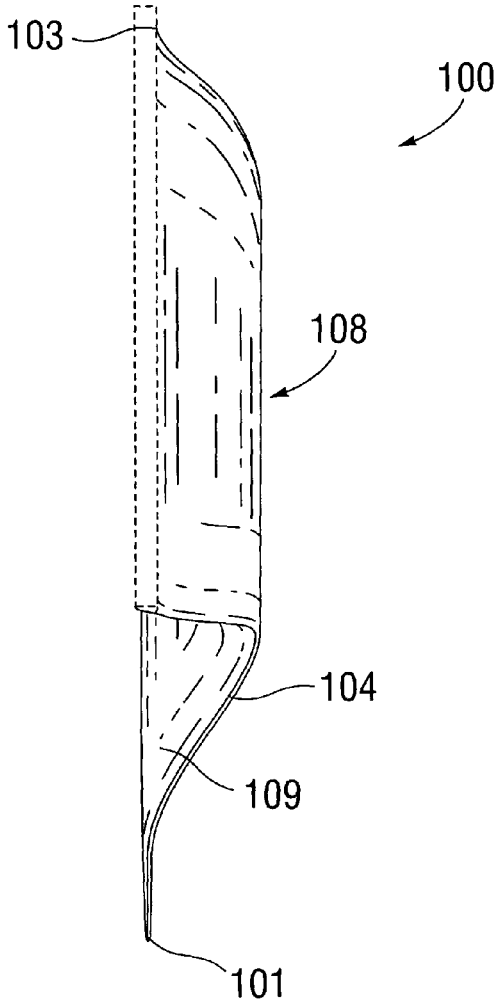

Referring concurrently to FIGS. 4 and 5 (which correlate, respectively, to FIGS. 2 and 3), the curvature of fin 100 is depicted as end views of the fins shown in FIGS. 2 and 3. The peaks 108 and valleys 109 are further defined in the plan views shown in FIGS. 4 and 5. That is, FIGS. 4 and 5 are views of the fin 100 rotated 90° relative to FIGS. 2 and 3, respectively.

The composite view of fin 100 as depicted in FIGS. 1-5 shows that the fin 100 incorporates a curved section intermediate the base 101 and the top end 103. A nearly vertical portion extends from the base 101 into the curved sections 108/109. The curvature of the fin 100 (also referred to as an arcuate section) is then reversed such that the fin body or sail returns to the nearly vertical shape such that upper section 103 and the lower body section 101 of the sail are essentially co-planar with each other with a curvilinear segment 108/109 therebetween.

This configuration defines a fin with a "tunnel-like" section 108 which operates to funnel the water between adjacent fins 100 to create a controlled turbulence therein.

Figure 6:
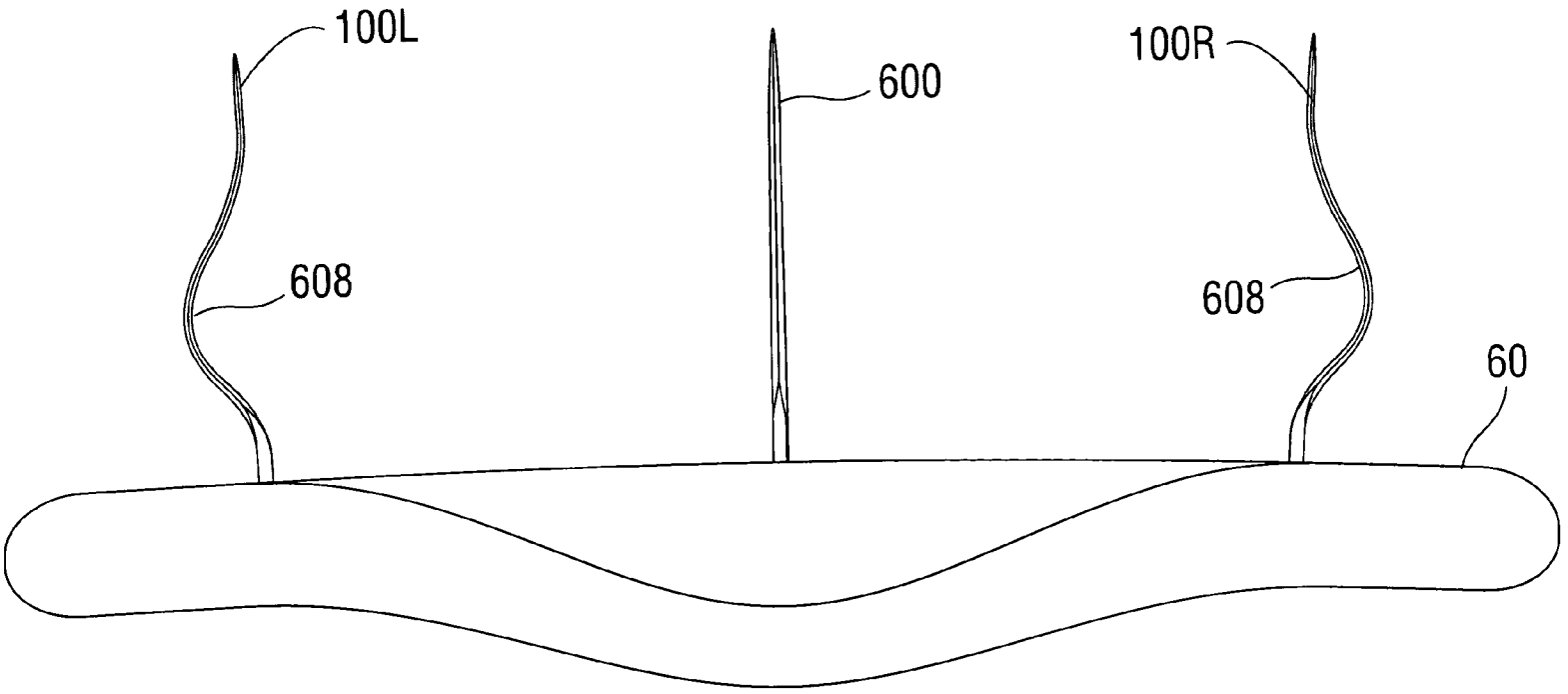
FIG. 6 is a front end view of a surfboard showing a typical horizontally spaced arrangement of fins on a surfboard.

Referring now to FIG. 6, there is shown a nose (or front) end view of a typical surfboard 60. The surfboard design is conventional (or generic) and forms no significant part of the invention, per se.

Fins 100L and 100R are substantially identical to fin 100 shown and described supra. The designators "L" and "R" merely denote the placement of the fins (to the Left or to the Right) relative to the centerline of the surfboard in FIG. 6. A generic or conventional fin 600 may, typically, be mounted at the longitudinal center line of the surfboard 60.

This placement of the contoured fins 100R and 100L is referred to as the "bow-legged embodiment" because of the opposed positions of the curved sections 608 of the adjacent fins.

By reversing the positions of fins 100R and 100L, see FIGS. 2 and 3, the so-called "knock-kneed" configuration discussed supra is achieved. In each of these combinations, the water passing between curved portions of the fins produces different hydraulic actions on the surfboard.

Figure 7:
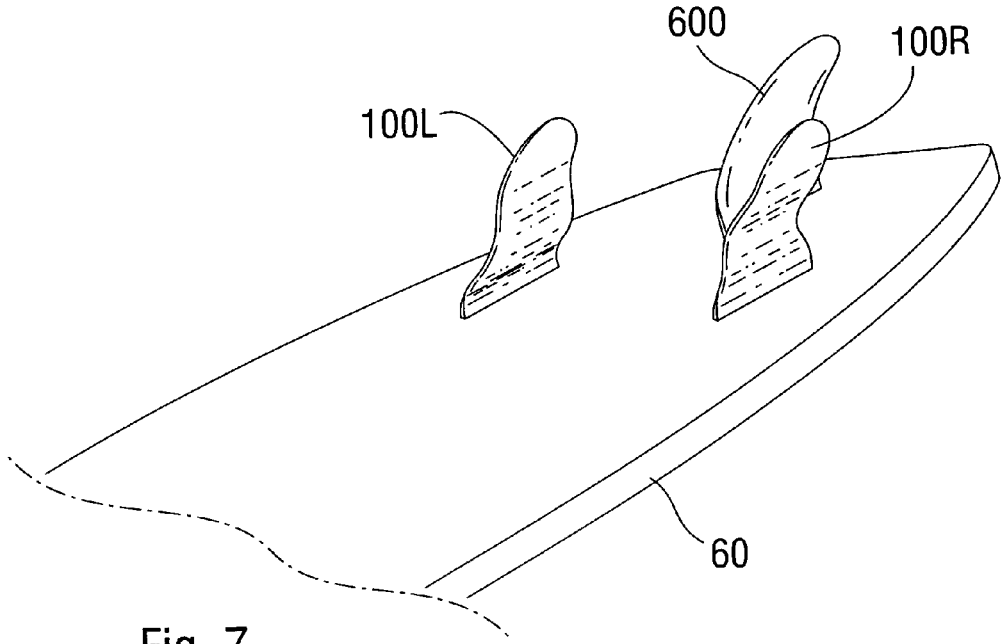
FIGS. 7 and 8 are broken away views of the tail ends of surfboards with different patterns of fin placement thereon.
Figure 8:
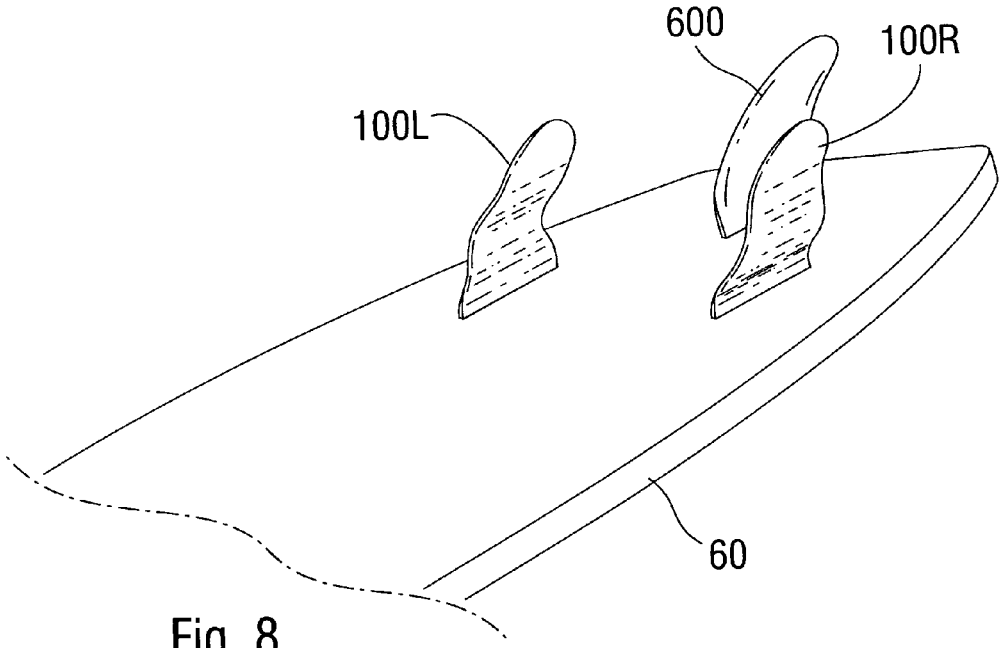

As can be readily seen in FIG. 6, the fins 100 are fabricated in similar shapes but can have opposing or mirror configurations Referring now to FIGS. 7 and 8, there is shown a broken-away tail (or fin) end portion of a typical surfboard 60, as described supra. The surfboard 60, per se, forms no part of the invention. In these Figures, there are shown representative arrangements or positioning of fins on the surfboard.

For example, in FIG. 7 three (3) fins are shown arranged in a staggered array from front to back on the surfboard. In this arrangement, fin 100L is located closer to the left side of the surfboard. While fin 100R is located closer to the right edge of the surfboard, the generic fin 600 is disposed intermediate the fins 100R and 100L in one or both of the spacings thereof, i.e., front-to-back and side-by-side.

Conversely, in FIG. 8 three (3) fins are also shown arranged on the surfboard In this arrangement. The fins are shown in staggered relationship from left to right. Thus, fin 100L is located closer to the left edge of the surfboard and fin 100R is located closer to the right edge of the surfboard. The generic fin 600 is disposed intermediate the fins 100R and 100L in one or both of the spacings thereof, i.e., front-to-back and side-by-side.

The placement of the fins 100L and 100R is selected and determined by the surfer in conjunction with the water currents, the skill of the rider and the "right-foot" or "left-foot" preference of the rider.

Figure 9:
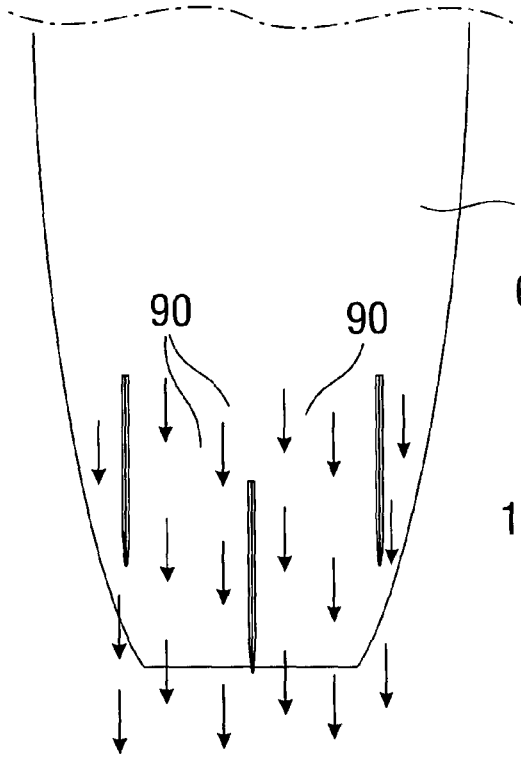
FIGS. 9 and 10 are illustrations of water activity with regard to multiple fin arrangements as suggested in FIGS. 6, 7 and 8.
Figure 10:
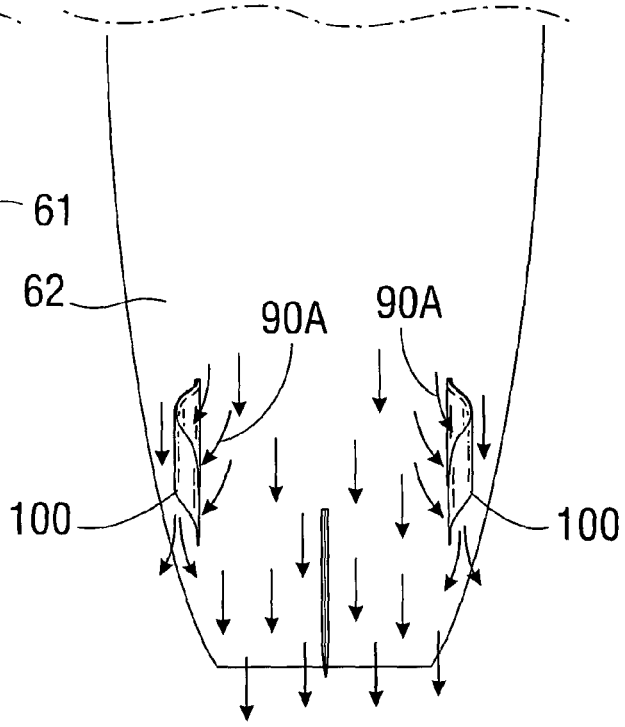

FIGS. 9 and 10 are broken away portions of surfboards illustrating water flow patterns created by the fins 100R and 100L in conjunction with the generic fin 600. In particular, FIG. 9 represents the conventional linear flow of water as depicted by straight arrows 90 between several generic fins.

Conversely, the curved arrows 90A shown in FIG. 10 indicate the altered water flow as created by the sinuous (curved) fins 100 shown and described supra. This altered water flow produces several effects in the performance of the surfboard. The board rider can utilize the water flow characteristics to perform (or enhance) tricks or maneuvers while surfing.

Referring now to FIGS. 11A through 11D, there are shown edge views of fins with variations of the "single curvature segment" or "arcuate sections" thereof. This representative group of fin configurations provides variations of the fins described supra. Each of these single curvature fins provides unique cavitation patterns and effects on the water which passes between the adjacent fins. These cavitation patterns permit the board rider to perform different rides of the board.

As shown in FIGS. 11A, 11B, 11C, and 11D, the fins include a base 1101 A, B, C, or D which is constructed to function as the base 101 shown in FIGS. 1-5.

Figures 11A, 11B, 11C, 11D:
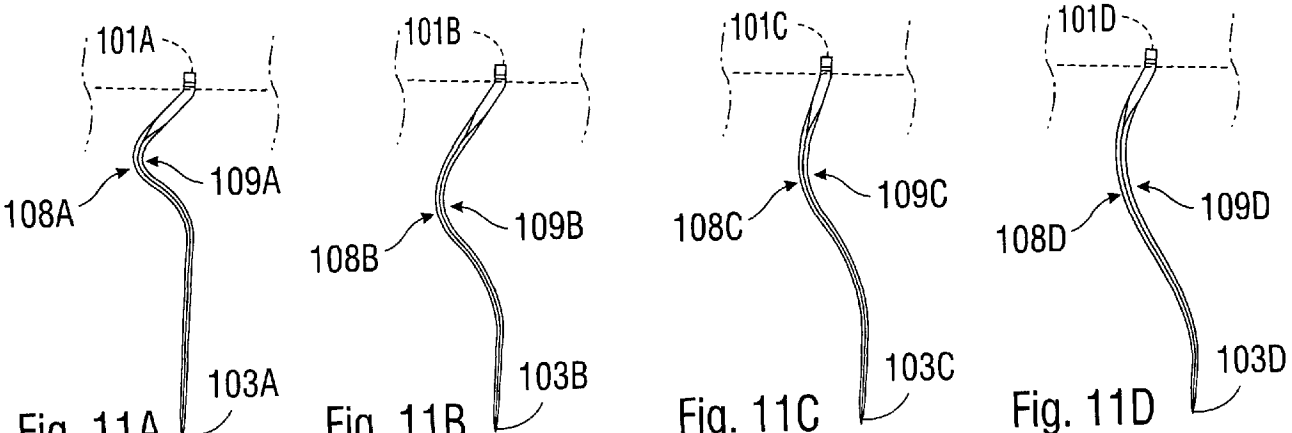
FIGS. 11A, 11B, 11C and 11D each show edge views of representative fins having a single curved portion.
Figures 12A, 12B, 12C, 12D:
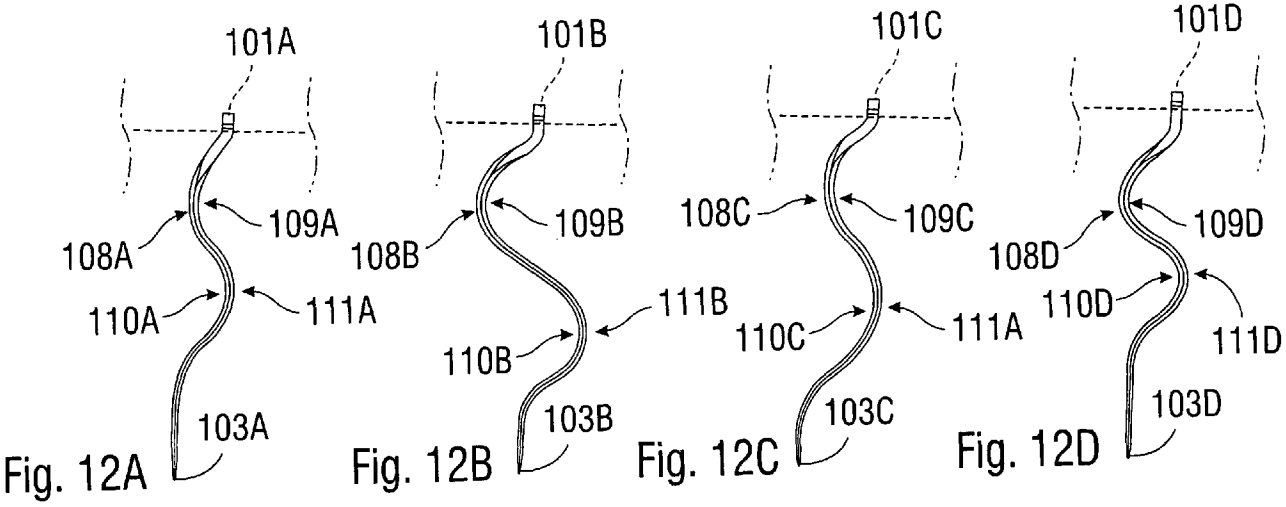
FIGS. 12A, 12B, 12C and 12D each show edge views of representative fins with at least two curved segments thereon.

In similar fashion, FIGS. 11A to 110 also include tips 1103 A, B, C, or D which correspond to the tips 103 in prior Figures; as well as peaks 1108 A, B. C, or D; as well as valleys 1109 A, B, C, or D.

As will be seen, each of the tips 1103 A, B, C, or D is vertically aligned with the base 1101 A, B, C, or D, respectively.

The curvature portion of the fins comprising peaks 1106 A, B, C, or D and the associated valleys 1109 A, B, C, or D are substantially horizontally included between the respective bases 1101 A, B, C, or D and tips 1103 A, B, C, or D.

When the fins 11 A, B, C, and/or D are arranged in a face-to-face arrangement with a counterpart fin (or to a lesser degree, with a conventional fin) they produce the cavitation forces previously discussed.

Referring now to FIGS. 12A through 12D, there are shown frontal edge views of another embodiment of fins 100. Each of these fins is shown with a "dual curvature segment." The dual curvature fins also provide certain cavitation patterns and effects on the water which passes between the adjacent fins and, thus, affects the performance of the surfboard. These cavitation patterns permit the board rider to perform different rides of the board.

As shown in FIG. 12A, 12B, 12C, or 12D, the fins include a base 1201 A, B, C, or D which is constructed to function as the base 101 shown in FIGS. 1-5.

Likewise, FIGS. 12A to 12D also include tips 1203 A, B, C, or D which correspond to the tips 103 in prior Figures. The peaks 1208 A, B. C, or D as well as valleys 1209 A, B, C, or D are also shown.

As previously noted, each of the tips 1203 A, B, C, or D is vertically aligned with the bases 1201 A, B, C, or D, respectively. In this configuration, the dual curvature portion of the fins, comprising peaks 1206 A, B, C, or D, and peaks 1210 A, B, C, or D, together with valleys 1209 A, B, C, or D as well as valleys 1212 A, B, C, or D are both positioned, in series, intermediate the respective bases 1201 A, B, C, or D and tips 1203 A, B, C, or D.

When the fins 1206 A, B, C, and/or D are positioned in a face-to-face arrangement with a counterpart fin 1212 A, B, C, and/or D (or to a somewhat lesser degree, with a conventional fin) produce the cavitation forces previously discussed.

These curved fins allow a surfer a higher performance way of riding a wave. The advantage of fins which are curved outwardly is the increased hydrodynamic suction of a surfboard to the water's surface than is provided by a conventional flat surf fin. This expanded "attachment" of the surfboard to the water's surface permits a surfer to have better balance and perform more radical turns on a wave. This advantage of stability for a surfer will generally permit higher performance style in wave riding.

The preferred embodiment of the invention is the use of fins that are "bow-legged" in shape, as described. Whether the fin is only slightly bowed relative to the vertical center thereof or extremely bowed, the outward circular curvature creates a unique interaction between the surfboard and the surface of the water.

Thus, there is shown and described a unique concept and design of a surfboard fin. While this description is directed to a particular embodiment, it is understood that those skilled in the art may conceive modifications and/or variations to the specific embodiments shown and described herein. Though a single fin is shown and described, the fin is more effective when used in pairs as shown in the figures. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

The invention claimed is:

1. An attachment for use with a surfboard to enhance the performance of the surfboard, comprising;

a base which is adapted for mounting at the underside of a surfboard, and a generally triangular shaped planar body with one side thereof integrally joined to and extending from said base;

said planar body including at least two contiguous arcuate sections integrally formed therein and spaced away from said base;

said arcuate sections are arranged in seriatim and in close proximity to each other to form a generally S-shaped unitary curved section of said planar body;

each of said contiguous arcuate sections is integrally formed in the opposite surfaces of said planar body;

said arcuate sections are disposed substantially parallel to said base.

2. The attachment recited in claim 1 wherein, said planar body is fabricated of a composite material.

3. The attachment recited in claim 1 wherein, at least one of said contiguous arcuate sections defining an angle of greater than 90°.

4. The attachment recited in claim 3 wherein, each said unitary curved section of said planar body establishes a channel for water passing beneath the surfboard.

5. The attachment recited in claim 1 wherein, said planar body includes at least four contiguous arcuate sections.

6. The attachment recited in claim 5 wherein, said arcuate sections are arranged in close proximity to each other to form a plurality of curved sections in said planar body.

7. The attachment recited in claim 1 wherein, said base is designed to permit mounting thereof into a slot in the underside of said surfboard.

8. The attachment recited in claim 1 wherein, said planar body is substantially as wide as said base where said planar body extends from said base.

9. The attachment recited in claim 1 wherein, the front and rear edges of the triangular shaped planar body are tapered to enhance the passage thereof through water.

10. The attachment recited in claim 1 wherein, said base is shaped to enhance the mounting of said base to the underside of a surfboard.

11. The attachment recited in claim 1 wherein, the surfaces of said planar body including said arcuate sections are made smooth.

12. The attachment recited in claim 6 wherein,
each said arcuate section is oriented to be horizontal to said base.

13. An attachment for use with a surfboard, comprising,
a base which is adapted for mounting the attachment to the underside of a surfboard, and
a generally triangular shaped planar body integrally formed with and extending from said base,
said planar body including at least two contiguous arcuate sections,
said arcuate sections are arranged on opposite surfaces of said planar body and are disposed substantially parallel to said base,
said arcuate sections are arranged in close proximity to each other to form a generally S-shaped, unitary curved section of said planar body.

14. The attachment recited in claim 13 wherein,
each of said arcuate sections is generally C-shaped.

15. The attachment recited in claim 13 wherein,
at least one of said arcuate sections includes a curve which is greater than 180°.

16. The attachment recited in claim 15 wherein,
said arcuate sections on each surface of said planar body alternate in the direction of curvature thereof.

17. The attachment recited in claim 13 wherein,
all of said arcuate sections are rounded so that the planar body has a sinuous configuration at each edge.

18. A surfboard fin comprising,
a base which is adapted for mounting the fin to the underside of a surfboard, and
a generally triangular shaped planar body fabricated integrally with said base,
said planar body is formed in a swept-back configuration so that the upper end of said planar body is positioned adjacent the rearward end of said base,
said planar body includes at least two contiguous curved sections formed therein in a generally S-shaped configuration,
said curved sections are formed on opposite surfaces of said planar body and are disposed substantially parallel to each other and to said base, such that said planar body has a vertically sinuous configuration therein as related to said base.

19. The attachment recited in claim 18 wherein,
said arcuate sections are arranged in close proximity to each other to form a generally S-shaped, unitary curved sections of said planar body.

20. An improved fin structure for use with a surfboard to permit improved manipulation of the surfboard while surfing,
said fin includes;
a base which is constructed so that the fin can be used as an add-on feature or as an original equipment with a surfboard;
a control element integrally formed with said base for attachment to the underside of said surfboard;
said control element includes;
an elongated body which is attached to the surfboard by said base and depends below the surface of the water;
said elongated body is generally planar with at least two curved sections formed therein;
said curved sections are disposed within the elongated body such that the curved sections are curved in the opposite direction to form a generally sinuous bend in the elongated body wherein the ends of the elongated body are substantially co-planar.

* * * * *